US007406274B2

(12) United States Patent
Shin et al.

(10) Patent No.: US 7,406,274 B2
(45) Date of Patent: Jul. 29, 2008

(54) CONTROLLING APPARATUS FOR DEVELOPING ROLLER, IMAGE FORMING DEVICE HAVING THE SAME, AND DEVELOPER CONTROLLING METHOD THEREOF

(75) Inventors: Joong-Kwang Shin, Seongnam-si (KR); Yu-Man Kim, Seongnam-si (KR); Hae-Ree Joo, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 315 days.

(21) Appl. No.: 11/292,111

(22) Filed: Dec. 2, 2005

(65) Prior Publication Data

US 2006/0153585 A1 Jul. 13, 2006

(30) Foreign Application Priority Data

Jan. 13, 2005 (KR) ..... 10-2005-0003263

(51) Int. Cl.
*G03G 15/10* (2006.01)

(52) U.S. Cl. ..... 399/57; 399/61; 399/62

(58) Field of Classification Search ..... 399/53, 399/54, 57, 58, 61, 62
See application file for complete search history.

(56) References Cited

U.S. PATENT DOCUMENTS

| | | | | |
|---|---|---|---|---|
| 6,575,096 | B1 * | 6/2003 | Caruthers et al. | 399/54 |
| 6,600,884 | B2 * | 7/2003 | Shimmura | 399/57 |

FOREIGN PATENT DOCUMENTS

| | | |
|---|---|---|
| JP | 08-146736 | 6/1996 |
| JP | 2002-311725 | 10/2002 |
| KR | 99-45538 | 6/1999 |
| KR | 1020010038782 | 5/2001 |
| KR | 1020020070589 | 9/2002 |

* cited by examiner

*Primary Examiner*—William J Royer
(74) *Attorney, Agent, or Firm*—Roylance, Abrams, Berdo & Goodman, L.L.P.

(57) ABSTRACT

An image forming apparatus having a developer controlling apparatus for a developing roller is provided to uniformly control an amount of developer deposited on the developing roller and a developer controlling method thereof. The apparatus includes a sensing part having a first sensor which senses a conductivity of a liquid developer and a second sensor which senses a density of the liquid developer. A control part controls a voltage applied to the developing roller and/or a deposit roller according to the conductivity and the density sensed by the sensing part.

23 Claims, 8 Drawing Sheets

CONTROLLING APPARATUS FOR DEVELOPING ROLLER, IMAGE FORMING DEVICE HAVING THE SAME, AND DEVELOPER CONTROLLING METHOD THEREOF

CROSS-REFERENCE TO RELATED APPLICATIONS

This application claims the benefit under 35 U.S.C. § 119 (a) of Korean Patent Application No. 2005-3263, filed on Jan. 13, 2005, the entire disclosure of which is hereby incorporated by reference.

BACKGROUND OF THE INVENTION

1. Field of the Invention

The present invention relates to an image forming apparatus, such as an electrophotographic printer that uses a liquid developer. More particularly, the present invention relates to a developer controlling apparatus for a developing roller that uniformly controls an amount of developer deposited on a developing roller, an image forming device having the same, and a developer controlling method thereof.

2. Description of the Related Art

Generally, an image forming device, such as an electrophotographic printer, forms an electrostatic latent image on a photoconductor, such as a photoconductive belt or an organic photoconductive drum (OPC). The latent image is developed with a developer having a predetermined color. The developed image is transferred onto an image receiving medium, such as a sheet of record paper (P), thereby obtaining a desired image.

Such an electrophotographic image forming device is classified into a wet type or a dry type, depending on the developer employed therein. A wet type electrophotographic image forming apparatus uses a liquid developer formed by mixing powdered toner with a liquid carrier having volatile components.

FIG. 1 shows a conventional wet type electrophotographic color printer 1 using a liquid developer.

As shown in FIG. 1, the wet type electrophotographic color printer 1 includes an image forming unit 5.

The image forming unit 5 includes four image forming units, for example K, C, M and Y image forming units, to form an image having four colors, that is, black (K), cyan(C), magenta (M), and yellow (Y).

Each of K, C, M and Y image forming units is provided with a photoconductor 9 such as an OPC drum. An electrification roller 12 is disposed adjacent to the photoconductor 9 for electrifying the surface of the photoconductor 9 with a predetermined electric potential. A laser scanning unit 11 emits a light beam onto the electrified surface of the photoconductor 9 to form an electrostatic latent image having a low electric potential thereon.

Below the photoconductor 9, a developing device 13 is disposed. The developing device 13 develops the electrostatic latent image with liquid developer 48 having a predetermined color, that is, K, C, M or Y. The liquid developer 48 also has a density ranging from about 3% through 20% solid. Consequently, a developer image 49 (see FIG. 2) is formed having a density in the range of about 20% through 25% solid.

As shown in FIG. 2, the developing device 13 includes a storage part 6, a developing roller 7, a deposit roller 14, a metering roller 15, and a cleaning roller 16.

The storage part 6 reserves a liquid developer 48. The developing roller 7 is located below the photoconductor 9.

The deposit roller 14 is located below the developing roller 7. The deposit roller 14 and the developing roller 7 apply predetermined electrical forces to the liquid developer 48 to form a difference in electric potential ΔV, that is, a deposit vector V, therebetween. Due to the difference in electric potential ΔV, the liquid developer 48 is deposited on the developing roller 7, thereby forming a layer of developer thereon. The layer of developer has a high density in the range of 12% through 20% solid and a uniform amount of developer M/A. The metering roller 15 is located on an upper portion of the developing roller 7 and substantially over the deposit roller 14. The metering roller 15 applies a predetermined pressure to the layer of developer formed on the developing roller 7. At the same time, the metering roller 15 applies a predetermined electric force to the regulated layer of developer to ensure that it remains on the developing roller 7 and does not attach to the metering roller 15.

When the layer of developer formed on the developing roller 7 moves to a nip between the developing roller 7 and the photoconductor 9, and comes to contact with the photoconductor 9, a predetermined difference in electric potential is formed between the developing roller 7 and the electrostatic latent image having the low electric potential formed on the photoconductor 9. The layer of developer is attached to the electrostatic latent image of the photoconductor 9, by the predetermined difference in electric potential, so that the electrostatic latent image of the photoconductor 9 is developed into a developer image.

The cleaning roller 16 is located on the opposite side of the lower portion of the developing roller 7 from the deposit roller 14. The cleaning roller 16 cleans developer remaining on the developing roller 7 after the electrostatic latent image of the photoconductor 9 is developed.

To uniformly control an amount of developer M/A deposited on the developing roller 7 by the deposit roller 14, the conventional printer 1 further includes an amount-of-developer controlling unit 70. The amount-of-developer controlling unit 70 controls deposit vector V by determining an applied voltage for the developing roller 7 and/or the deposit roller 14 on the basis of conductivity of the liquid developer 48.

The amount-of-developer controlling unit 70 includes a sensor part 71, a memory part 77, and a control part 74.

The sensor part 71 has a conductivity sensor to sense conductivity of the liquid developer 48. The conductivity sensor is disposed in the storage part 6 of each of the developing devices 13 of the K, C, M and Y image forming units 5, and submerged under the liquid developer 48.

The memory part 77 stores a plurality of values of deposit vector V predetermined by experiments. The plurality of values of deposit vector V are determined as values which can obtain a target amount of developer M/A according to varying conductivities.

The control part 74 selects a corresponding value of deposit vector V among the plurality of predetermined values of deposit vector V stored in the memory part 77 according to the conductivity sensed by the sensor part 71. The control part 74 controls a voltage applied to the developing roller 7 and/or the deposit roller 14 according to the selected value of deposit vector V.

However, as shown in FIG. 5, the conductivity of the liquid developer 48 generally has a characteristic that varies according to density (% solid), and also an electric charge Q/M (coulomb per mass) for the same density.

Further, as shown in FIG. 6, an amount of developer M/A deposited on the developing roller 7 has a characteristic that varies according to the conductivity of the liquid developer 48, and also the electric charge Q/M of the liquid developer 48 for the same conductivity.

Accordingly, if the value of deposit vector V is determined only by the conductivity, the amount of developer M/A which is actually deposited on the developing roller 7 may be different from the target amount of developer M/A as the density and/or the electric charge Q/M of the liquid developer 48 varies. Therefore, in this case, the layer of developer may not form on the developing roller 7 uniformly. As a result, the quality of final image, such as image density, image uniformity, dot reappearance ability, line reappearance ability, and a color gamete, can deteriorate.

As another method of controlling the deposit vector V during developing, an amount-of-developer controlling apparatus (not shown) has been proposed to control the values of deposit vector V on the basis of density.

However, like the amount-of-developer controlling unit 70 for controlling the values of deposit vector V on the basis of the conductivity of the liquid developer 48, since the amount-of-developer controlling apparatus determines the values of deposit vector V only with the density of the liquid developer 48, it also presents a problem in that the amount of developer M/A actually deposited on the developing roller 7 may be different from the target amount of developer M/A as the density and/or the electric charge Q/M of the liquid developer 48 varies. Thus, a layer of developer may not form uniformly on the developing roller 7.

Accordingly, to correctly and precisely deposit the amount of developer M/A on the developing roller 7 during the developing, and thereby uniformly form the layer of developer on the developing roller 7, it requires that the deposit vector V base determinations on the consideration of all factors including conductivity, density and an electrical charges, which can affect the amount of developer M/A, rather than one factor such a conductivity or a density.

Accordingly, there is a need for an improved image forming device including a developer controlling apparatus that controls voltage applied to a developing roller and/or a deposit roller based on a variety of factors.

SUMMARY OF THE INVENTION

An aspect of the present invention is to solve at least the above problems and/or disadvantages and to provide at least the advantages described below. Accordingly, an aspect of the present invention is to provide a developer controlling apparatus for a developing roller that controls a voltage applied to a developing roller and/or a deposit roller during the developing according to a conductivity and a density of a liquid developer, thereby correctly and precisely controlling an amount of developer M/A deposited on the developing roller, an image forming device having the same, and an developer controlling method thereof.

Another object of the present invention is to provide a developer controlling apparatus for a developing roller that controls a voltage applied to a developing roller and/or a deposit roller during the developing according to a conductivity and a density of a liquid developer, and an electric charge Q/M and an amount of developer M/A estimated by the conductivity and the density of the liquid developer, thereby correctly and precisely controlling an amount of developer M/A deposited on the developing roller, an image forming device having the same, and an developer controlling method thereof.

According to one aspect of the present invention, there is provided a developer controlling apparatus for a developing roller. The developer controlling apparatus includes a sensing part having a first sensor which senses a conductivity of a liquid developer and a second sensor which senses a density of the liquid developer, and a control part which controls a voltage applied to the developing roller and/or a deposit roller according to the conductivity and the density sensed by the sensing part.

Preferably, the first sensor is formed of a conductivity sensor which electrically senses the conductivity of the liquid developer, and the second sensor is formed of a density sensor which optically senses the density of the liquid developer.

The apparatus may further include a memory part which stores data predetermined according to conductivities and densities to determine the voltage applied to the developing roller and/or the deposit roller. In this case, the control part may select a value corresponding to the conductivity and the density sensed by the sensing part from the data, and thereby control the voltage applied to the developing roller and/or the deposit roller.

The data stored in the memory part may include a predetermined plurality of values of electric charge Q/M according to the conductivities and the densities, a predetermined plurality of values of amount of developer M/A according to the plurality of values of electric charge Q/M and the conductivities, and a predetermined plurality of values of deposit vector V according to the plurality of values of amount of developer M/A and the conductivities for controlling an amount of developer M/A on the developing roller to a target amount of developer M/A. Here, the values of deposit vector V are values of difference in electric potential between the deposit roller and the developing roller. At this time, the control part estimates a present electric charge Q/M from a value of electric charge Q/M corresponding to the conductivity and the density sensed by the sensing part, stored in the memory part, estimates a present amount of developer M/A from a value of amount of developer M/A corresponding to the estimated present electric charge Q/M and the sensed conductivity stored in the memory part, determines a deposit vector V from a value of deposit vector V corresponding to the estimated present amount of developer M/A and the sensed conductivity stored in the memory part, and then controls the voltage applied to the developing roller and/or the deposit roller according to the determined deposit vector V.

Alternatively, the data stored in the memory part may includes a plurality of values of deposit vector V predetermined according to the conductivities and the densities for controlling an amount of developer M/A on the developing roller to a target amount of developer M/A. Here, the values of deposit vector V are values of difference in electric potential between the deposit roller and the developing roller. At this time, the control part determines a deposit vector V from a value of deposit vector V corresponding to the conductivity and the density sensed by the sensing part, stored in the memory part, and then controls the voltage applied to the developing roller and/or the deposit roller according to the determined deposit vector V.

According to another aspect of the present invention, an image forming device device includes an image forming unit having a developing roller for attaching a liquid developer to a electrostatic latent image to develop the electrostatic latent image into a visible image, and a deposit roller for depositing the liquid developer to the developing roller to form a layer of developer, and a developer controlling unit for controlling an amount of developer M/A deposited on the developing roller by the deposit roller. The developer controlling unit includes a sensing part having a first sensor which senses a conductivity of a liquid developer and a second sensor which senses a density of the liquid developer, and a control part which controls a voltage applied to the developing roller and/or a deposit roller according to the conductivity and the density sensed by the sensing part.

Preferably, the first sensor is formed of a conductivity sensor to electrically sense the conductivity of the liquid developer, and the second sensor is formed of a density sensor to optically sense the density of the liquid developer.

The developer controlling unit may further include a memory part for storing data predetermined according to conductivities and densities to determine the voltage applied to the developing roller and/or the deposit roller. In this case, the controlling part may select a value corresponding to the conductivity and the density sensed by the sensing part from the data, and thereby control the voltage applied to the developing roller and/or the deposit roller.

The data stored in the memory part may include a predetermined plurality of values of electric charge Q/M according to the conductivities and the densities, a predetermined plurality of values of amount of developer M/A according to the plurality of values of electric charge Q/M and the conductivities, and a predetermined plurality of values of deposit vector V according to the plurality of values of amount of developer M/A and the conductivities for controlling an amount of developer M/A on the developing roller to a target amount of developer M/A. Here, the values of deposit vector V are values of difference in electric potential between the deposit roller and the developing roller. At this time, the control part estimates a present electric charge Q/M from a value of electric charge Q/M corresponding to the conductivity and the density sensed by the sensing part, stored in the memory part, estimates a present amount of developer M/A from a value of amount of developer M/A corresponding to the estimated present electric charge Q/M and the sensed conductivity stored in the memory part, determines a deposit vector V from a value of deposit vector V corresponding to the estimated present amount of developer M/A and the sensed conductivity stored in the memory part, and then controls the voltage applied to the developing roller and/or the deposit roller according to the determined deposit vector V.

Alternatively, the data stored in the memory part may include a predetermined plurality of values of deposit vector V according to the conductivities and the densities for controlling an amount of developer M/A on the developing roller to a target amount of developer M/A. Here, the values of deposit vector V are values of difference in electric potential between the deposit roller and the developing roller. At this time, the control part determines a deposit vector V from a value of deposit vector V corresponding to the conductivity and the density sensed by the sensing part stored in the memory part, and then controls the voltage applied to the developing roller and/or the deposit roller according to the determined deposit vector V.

According to another aspect of the present invention, a developer controlling method of an image forming device includes the steps of sensing conductivity and density of a liquid developer, and controlling a voltage applied to a developing roller and/or a deposit roller according to the sensed conductivity and density.

The step of sensing the conductivity and the density may be carried out by electrically sensing the conductivity of the liquid developer, and optically sensing the density of the liquid developer.

The step of controlling the voltage may include determining a voltage applied to the developing roller and/or the deposit roller according to the sensed conductivity and density, and controlling a voltage applying to the developing roller and/or the deposit roller according to the determined voltage.

The step of determining the voltage may include estimating a present electric charge Q/M according to the sensed conductivity and density, estimating a present amount of developer M/A according to the estimated present electric charge Q/M and the sensed conductivity, and determining a deposit vector V for controlling an amount of developer M/A of the developing roller to a target amount of developer M/A according to the estimated amount of developer N/A and the sensed conductivity. Here, the deposit vector V means a difference in electric potential between the deposit roller and the developing roller.

Alternatively, the step of determining the voltage may include estimating a deposit vector V according to the sensed conductivity and density. Here, the deposit vector V means a difference in electric potential between the deposit roller and the developing roller.

The step of controlling the applying voltage may be carried out by controlling a voltage applied to the developing roller and/or the deposit roller according to the determined deposit vector V.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 3:
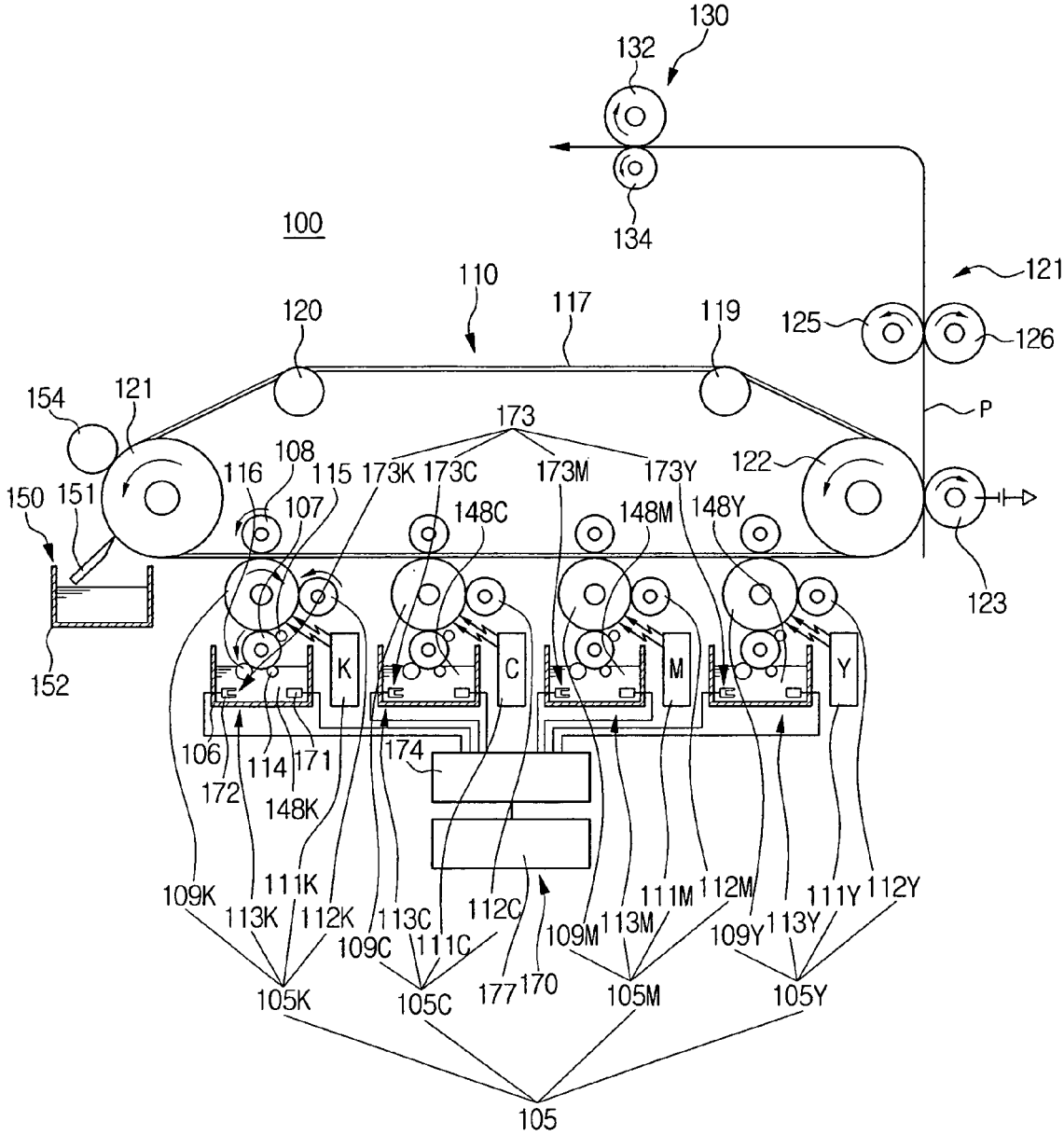
FIG. 3 is a schematic view of a wet type electrophotographic printer in which a developer-amount apparatus for a developing roller according to an exemplary embodiment of the present invention is applied.

FIG. 3 schematically shows an image forming device in which a developer controller for a developing roller apparatus in accordance with an exemplary embodiment of the present invention is applied.

The image forming device is a wet type electrophotographic color printer 100 that implements printing by internally processing print data transmitted from a source such as a computer (not shown).

As shown in FIG. 3, the wet type electrophotographic color printer 100 includes an image forming unit 105, a developer controlling unit 170, an image transfer unit 110, an image fixing unit 121, a paper discharge unit 130, and a cleaning unit 150.

The image forming unit 105 includes four image forming units, for example K, C, M, and Y image forming units 105K, 105C, 105M, and 105Y to form developer images 149 (see FIG. 4) of four colors, that is, black (K), cyan (C), magenta (M) and yellow (Y).

Each of the K, C, M, and Y image forming units 105K, 105C, 105M, and 105Y is provided with K, C, M, or Y photoconductors 109K, 109C, 109M, or 109Y; K, C, M, or Y electrification rollers 112K, 112C, 112M, or 112Y; K, C, M, or Y laser scanning units 111K, 111C, 111M, or 111Y; and K, C, M, or Y developing devices 113K, 113C, 113M, or 113Y.

The K, C, M, and Y photoconductors 109K, 109C, 109M, and 109Y, each of which is formed of an organic photoconductive drum, are disposed to form transfer nips with an image transfer belt 117 therebetween. On the K, C, M, and Y photoconductors 109K, 109C, 109M, and 109Y, the K, C, M, and Y developer images 149 having a density in the range of, for example, 20 through 25% solid are respectively formed by developing rollers 107 of the K, C, M, and Y developing devices 113K, 113C, 113M, and 113Y. Each of the developing rollers 107 has a layer of developer formed thereon in a density in the range of, for example, 12 through 20% solid and an amount of developer M/A of about 200 μg/cm^2 by corresponding K, C, M, or Y liquid developer 148K, 148C, 148M or 148Y having a density in the range of, for example, 3 through 20% solid.

The K, C, M, and Y electrification rollers 112K, 112C, 112M, and 112Y are respectively disposed to contact surfaces of the K, C, M, and Y photoconductors 109K, 109C, 109M, and 109Y, for electrifying surfaces thereof with a predetermined electric potential.

The K, C, M, and Y laser scanning units 111K, 111C, 111M, and 111Y are respectively located below the K, C, M, and Y electrification rollers 112K, 112C, 112M, and 112Y, for emitting light beams onto the electrified surfaces of the K, C, M, and Y photoconductors 109K, 109C, 109M, and 109Y to form electrostatic latent images thereon.

The K, C, M, and Y developing devices 113K, 113C, 113M, and 113Y are respectively installed below the respective K, C, M, and Y photoconductors 109K, 109C, 109M, and 109Y, for developing the electrostatic latent images into corresponding K, C, M, and Y developer images 149 with corresponding K, C, M, and Y liquid developers 148K, 148C, 148M and 148Y, as mentioned above.

Figure 4:
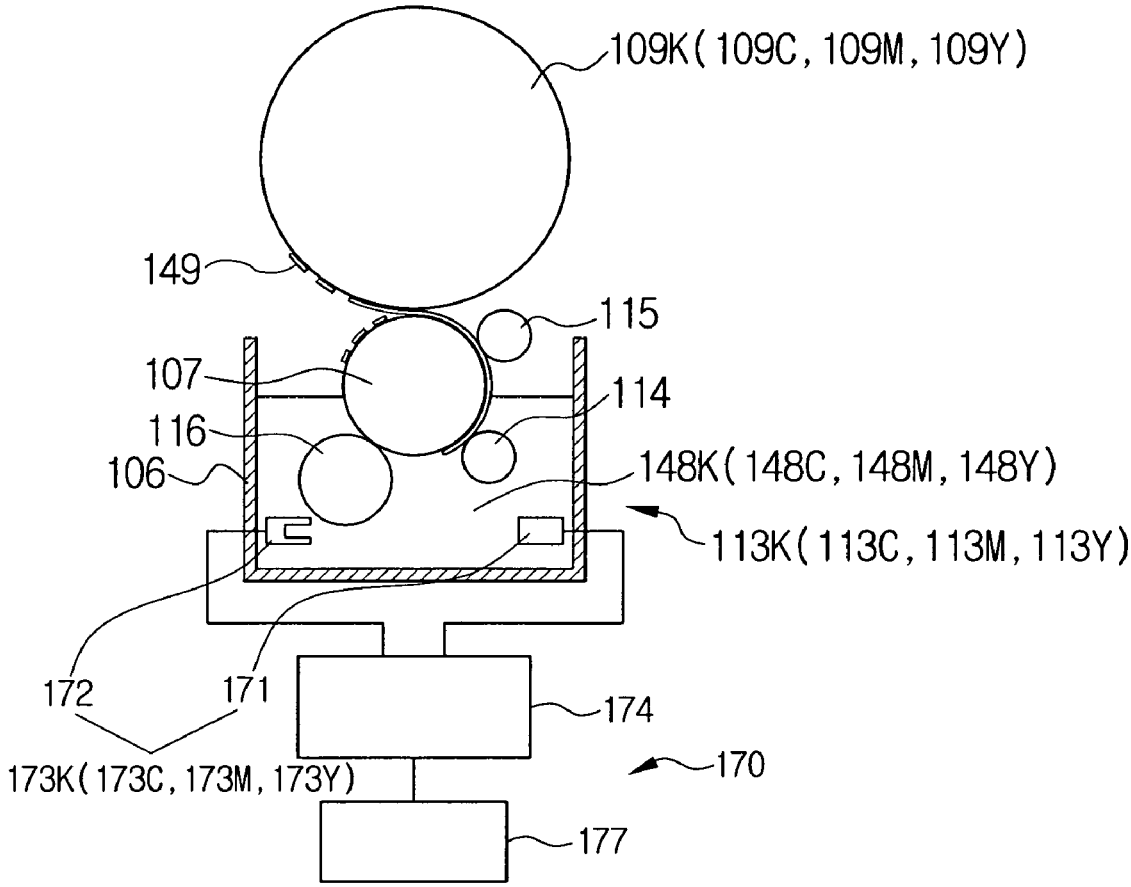
FIG. 4 is a schematic view exemplifying a developing device and a developer controlling unit of the wet type electrophotographic printer of FIG. 3.

As shown in FIG. 4, each of the K, C, M, and Y developing devices 113K, 113C, 113M, and 113Y include a storage part 106, a developing roller 107, a deposit roller 114, a metering roller 115, and a cleaning roller 116.

Figure 1:
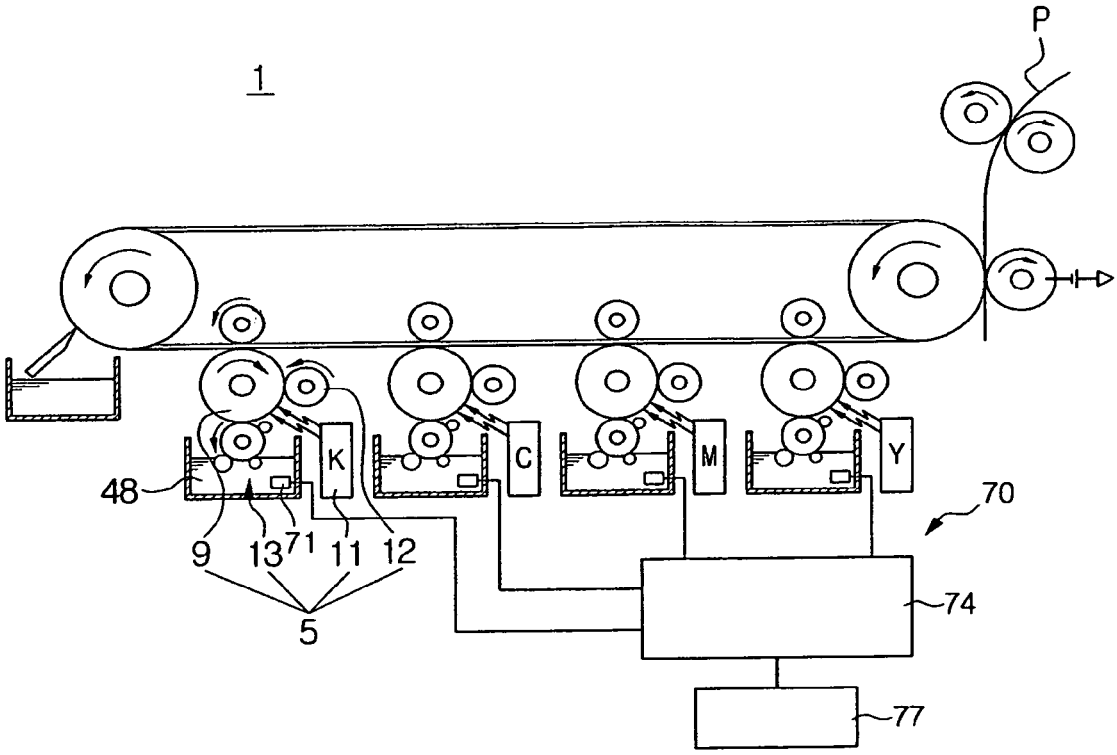
FIG. 1 (PRIOR ART)
FIG. 1 is a schematic view of a conventional wet type electrophotographic printer.
Figure 2:
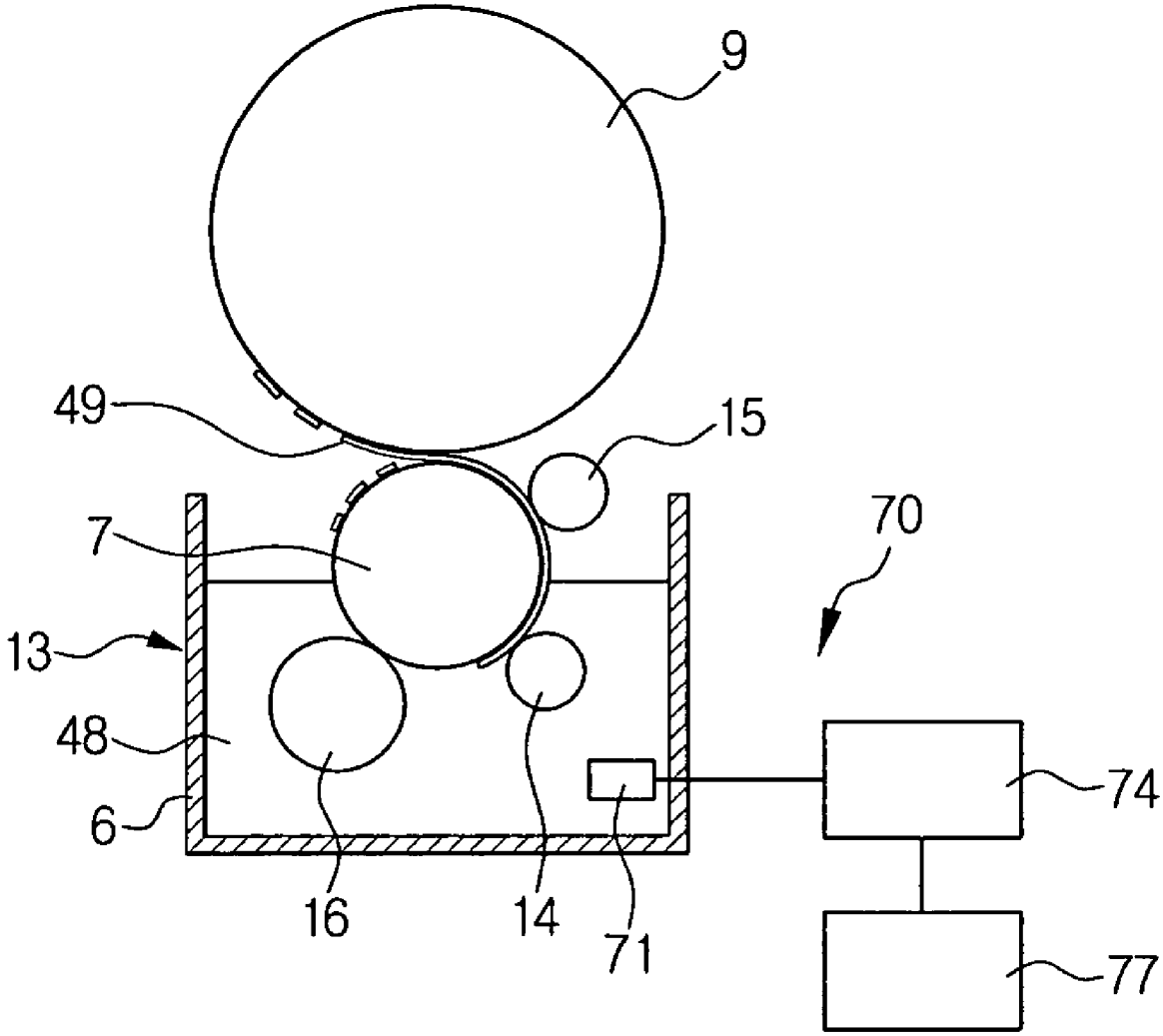
FIG. 2 (PRIOR ART)
FIG. 2 is a schematic view exemplifying a developing device and a developer controlling unit of the wet type electrophotographic printer of FIG. 1.

Since these components are the same as those of the developing devices 13 of the conventional printer 1 explained with reference to FIGS. 1 and 2, detailed descriptions thereof are omitted to provide a clear and concise description of the exemplary embodiments.

The developer controlling unit 170 is disposed with respect to the storage parts 106 of the K, C, M, and Y image forming units 105K, 105C, 105M, and 105Y, for uniformly controlling amounts of developer M/A deposited on the developing rollers 114 when at the K, C, M, and Y image forming units 105K, 105C, 105M, and 105Y, the deposit rollers 107 deposit corresponding K, C, M, and Y liquid developers 148K, 148C, 148M and 148Y on the developing rollers 107 to form corresponding layers of developer thereon, respectively.

The developer controlling unit 170 has a sensing part 173, a memory part 177, and a control part 174.

The sensing part 173 includes K, C, M and Y sensing parts 173K, 173C, 173M, and 173Y for sensing conductivities and densities of the K, C, M, and Y liquid developers 148K, 148C, 148M and 148Y of the K, C, M, and Y image forming units 105K, 105C, 105M, and 105Y, respectively.

Each of the K, C, M and Y sensing parts 173K, 173C, 173M, and 173Y is provided with a first sensor 171 and a second sensor 172. The first sensor 171 senses a conductivity of corresponding K, C, M, or Y liquid developer 148K, 148C, 148M or 148Y, and the second sensor 172 senses a density of corresponding K, C, M, or Y liquid developer 148K, 148C, 148M or 148Y.

Preferably, the first sensor 171 is formed of a conductivity sensor to electrically sense the conductivity of the K, C, M, or Y liquid developer 148K, 148C, 148M or 148Y, which can be commercially purchased at the market.

Also, the second sensor 171 is preferably formed of a density sensor to optically sense the density of the K, C, M, or Y liquid developer 148K, 148C, 148M or 148Y. The density sensor has a light emitting part and a light receiving part, and senses the density of the K, C, M, or Y liquid developer 148K, 148C, 148M or 148Y according to a rate or an amount of which the light receiving part receives light emitted from the light emitting part.

The memory part 177 stores a lookup data which enables the control part 174 to determine voltages applied to the developing rollers 107 and/or the deposit rollers 114, preferably the deposit roller 114, of the K, C, M, and Y image forming units 105K, 105C, 105M, and 105Y through a power supply (not shown), as will be described below. The lookup data is predetermined in accordance with experimental conductivities and densities.

The lookup data includes a plurality of values of electric charge Q/M corresponding to the conductivities and the densities, a plurality of values of amount of developer M/A corresponding to the values of electric charge Q/M and the conductivities, and a plurality of values of deposit vector V corresponding to the values of amount of developer M/A and the conductivities. Here, the values of deposit vector V are values of differences in electric potential ΔV between the deposit rollers 114 and the developing rollers 107. The differences in electric potential ΔV produce electric fields for controlling the amounts of developer M/A deposited on the developing rollers 107 to a target amount of developer M/A.

The values of electric charge Q/M, the values of amount of developer M/A, and the values of deposit vector V are determined through experimentation and consideration of all values of conductivities and densities which can occur during developing.

Figure 5:
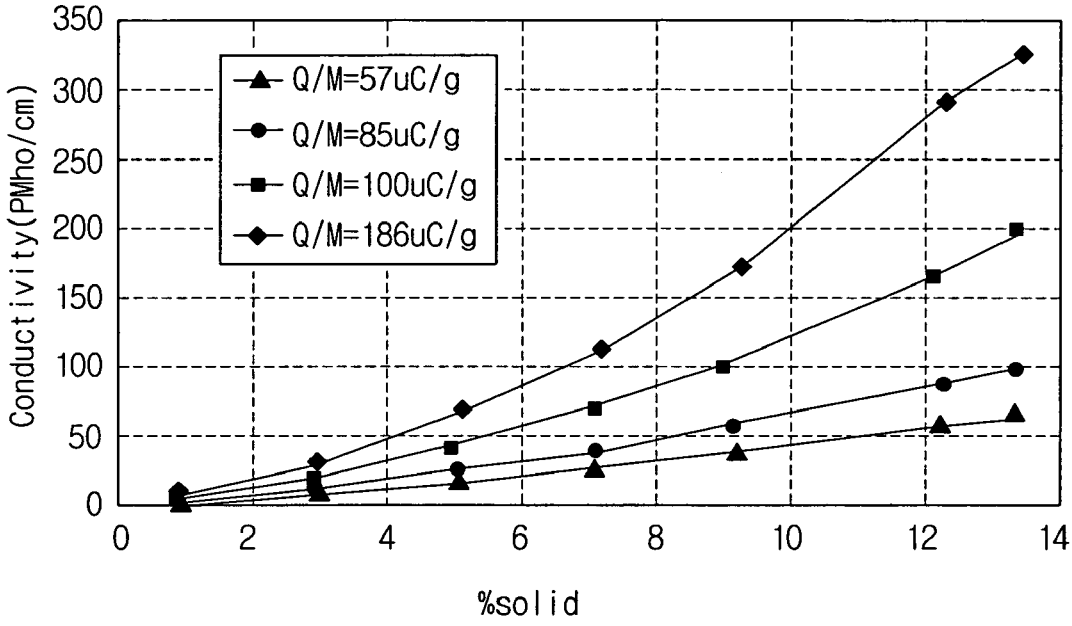
FIG. 5 is a graph exemplifying an electric charge Q/M corresponding to a conductivity and a density of liquid developer which is applied to the developer-amount apparatus according to the exemplary embodiment of the present invention.

FIG. 5 is a graph exemplifying an electric charge Q/M corresponding to the conductivity and a density of liquid developer. For example, if the conductivities and densities, which are sensed by the first and second sensors 171 and 172 of the K, C. M or Y sensing part 173K, 173C, 173M, or 173Y, are about 200 pMho/cm and about 13.2% solid, respectively, the electric charge Q/M comes to about 10 μC/g.

Figure 6:
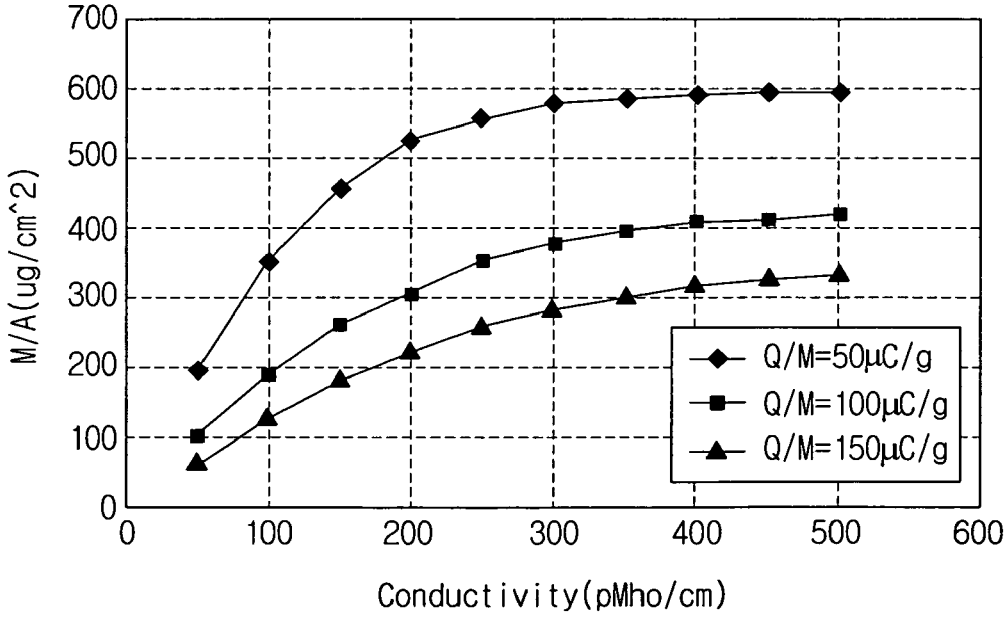
FIG. 6 is a graph exemplifying an amount of developer M/A corresponding to the conductivity and the electric charge Q/M which is applied to the developer-amount apparatus according to the exemplary embodiment of the present invention.

FIG. 6 is a graph exemplifying an amount of developer M/A corresponding to the conductivity and the electric charge Q/M. For example, if the electric charge Q/M is about 10 μC/g and the conductivity sensed by the first sensor 171 of the K, C. M or Y sensing part 173K, 173C, 173M, or 173Y is about 200 pMho/cm, the amount of developer M/A comes to about 300 μg/cm^2.

Figure 7:
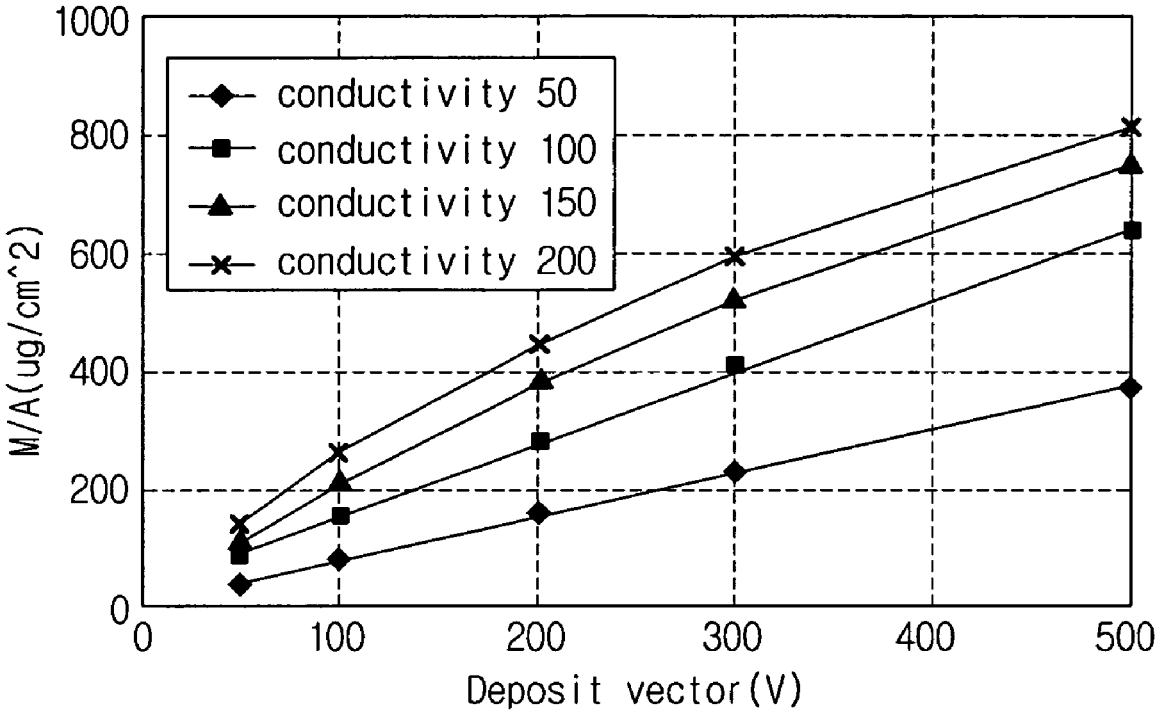
FIG. 7 is a graph exemplifying a deposit vector V corresponding to the conductivity and the amount of developer M/A which is applied to the developer-amount apparatus according to the exemplary embodiment of the present invention.

FIG. 7 is a graph exemplifying a deposit vector V corresponding to the conductivity and the amount of developer M/A when the target amount of developer M/A to be deposited on the developing roller 107 was set to, for example, about 200 μg/cm^2. For example, if the amount of developer M/A is about 300 μg/cm^2 and the conductivity is about 200 pMho/cm, the deposit vector V, that is, a difference in electric potential ΔV between the deposit roller 114 and the developing roller 107 to be controlled by the control part 174 through the power supply, comes to 130V.

Here, it should be noted that at FIG. 7, the deposit vector V is exemplified only in case when the target amount of developer M/A was set to about 200 μg/cm^2, but if the target amount of developer M/A is set to other values, the deposit vector V can be determined to values corresponding thereto.

The control part 174 selects values corresponding to conductivities and densities sensed by the first and second sensors 171 and 172 of the K, C, M and Y sensing parts 173K, 173C, 173M, and 173Y from the lookup data, and thereby controls voltages applied to corresponding deposit rollers 114 of the K, C, M and Y image forming units 105K, 105C, 105M, and 105Y through the power supply.

That is, the control part 174 estimates present electric charges Q/M from values of the electric charge Q/M corresponding to the conductivities and the densities sensed by the first and second sensors 171 and 172 of each of the K, C. M and Y sensing parts 173K, 173C, 173M, and 173Y, stored in the memory part 177. The control part 174 also estimates present amounts of developer M/A from values of the amount of developer M/A corresponding to the estimated present electric charges Q/M and the sensed conductivities stored in the memory part 177, determines deposit vectors V from values of the deposit vector V corresponding to the estimated present amounts of developer M/A and the sensed conductivities stored in the memory part 177, and then controls voltages applied to the deposit rollers 114 of the K, C, M and Y image forming units 105K, 105C, 105M, and 105Y according to the determined deposit vectors V.

As described above, the control part 174 determines the deposit vectors V in synthetic consideration of all factors including the conductivities, the densities and the electric charges Q/M of the liquid developers 148K, 148M, 148C and 148Y, which can affect the amounts of developer M/A deposited on the developing rollers 107, and controls the voltages applied to the deposit rollers 114 and/or the developing rollers 107 according to the determined deposit vectors V. Therefore, the developer controlling unit 170 can correctly and precisely control the amounts of developer M/A deposited on the developing rollers 107. In contrast, the developer controlling unit 70 of the conventional printer 1 determines the deposit vectors V with one factor such as the conductivities or the densities, and thereby controls the amounts of developer M/A. As a result, layers of developer formed on the developing rollers 107 are more uniformly controlled than those in the conventional printer 1. Moreover, the quality of the final image, such as the image density, the image uniformity, the dot reappearance ability, the line reappearance ability, and the color gamete can be improved.

Alternatively, to reduce a load of the control part 174 due to the logic calculation, the lookup data stored in the memory part 177 can include a plurality of values of deposit vector V corresponding to conductivities and densities. These values are calculated and by determining the relation among the values of the electric charge. Q/M according to the conductivities and the densities; the values of the amount of developer M/A; and the values of the deposit vector V, as described above.

In this case, the control part 174 determines deposit vectors V from corresponding values of the deposit vector V corresponding to conductivities and densities sensed by the first and second sensors 171 and 172 of the K, C, M and Y sensing parts 173K, 173C, 173M, and 173Y, stored in the memory part 177, and then controls voltages applied to the developing rollers 107 and/or the deposit rollers 114 of the image forming units 105K, 105C, 105M, and 105Y according to the determined deposit vectors V.

The image transfer unit 110 has four first image transfer rollers 108, a second image transfer roller 123 and the image transfer belt 117. The image transfer belt 117 rotates along a path of an endless track on first, second and third support rollers 119, 120, 121 which are driven by a belt driving roller 122. Each first image transfer roller 108 applies a predetermined voltage and pressure to the K, C, M or Y developer image 149K, 149C, 149M or 149Y formed on the corresponding photoconductor 109K, 109C, 109M or 109Y to form a developer image having density in the range of, for example, 25 through 30% solid. At the same time, the first image transfer roller 108 overlappingly transfers the developer image onto the image transfer belt 117. The second image transfer roller 123 transfers the developer image transferred to the image transfer belt 117 to an image receiving medium P, such as a sheet of record paper.

The image fixing unit 121 includes a heating roller 125 and a compressing roller 126 to fix the developer image transferred to the image receiving medium P with heat and pressure. The heating roller 125 applies heat to the developer image transferred to the image receiving medium P, and the compressing roller 126 compresses the image receiving medium P against the heating roller 125 with a predetermined pressure.

The paper-discharging unit 130 includes a paper-discharge roller 132 and a paper-discharge backup roller 134 for discharging the image receiving medium P out of the printer 100.

The cleaning unit 150 includes a cleaning roller 154, a cleaning blade 151, and a waste developer storage part 152 to clean developer refuse remaining on the image transfer belt 117 after the developer image is transferred onto the image receiving medium P. The cleaning roller 154 firstly cleans the developer refuse remaining on the image transfer belt 117, and the cleaning blade 151 removes the developer refuse firstly cleaned by the cleaning roller 154. The waste developer storage part 152 reserves the developer refuse removed from the image transfer belt 117 by the cleaning blade 151.

Although it has been exemplified herein that the image forming apparatus according to the exemplary embodiment of the present invention is applied to the wet type electrophotographic color printer 100 having the image transfer belt 117 as an image transfer member, it may be applied to other image forming apparatus, for example, a wet type electrophotographic color printer having an image transfer drum as an image transfer member in substantially the same principle and construction.

Figure 8:
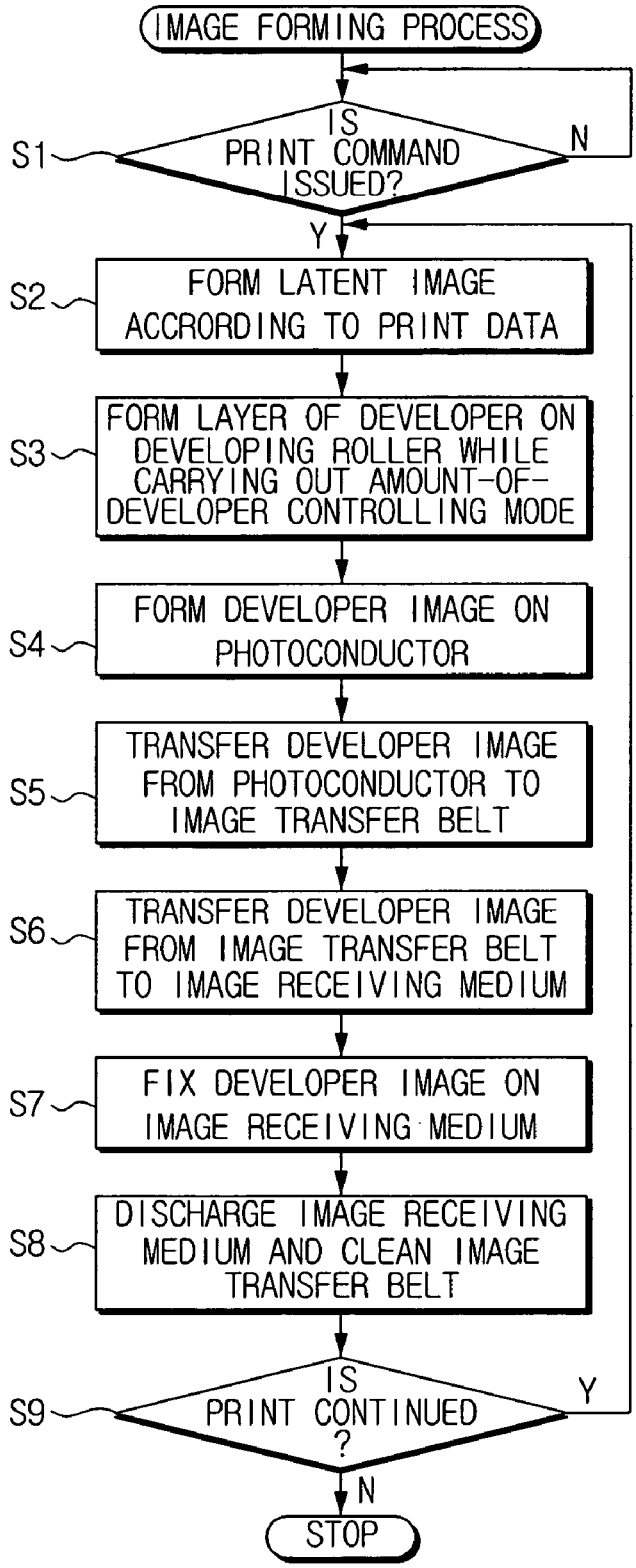
FIG. 8 is a flowchart exemplifying a process of an image forming method of the wet type electrophotographic printer of FIG. 3.

Hereinafter, an image forming method of the wet type electrophotographic printer 100 according to the exemplary embodiment of the present invention configured as described above is explained with reference to FIGS. 8 and 9.

At first, as a print command is issued (Step S1), the K, C, M and Y image forming units 105K, 105C, 105M and 105Y operate respective components thereof to perform a series of image forming operations for forming first page print data of four colors of K, C, M and Y.

Specifically, on the K, C, M and Y photoconductors 109K, 109C, 109M and 109Y are respectively formed electrified layers having low electric potential, that is, electrostatic latent images corresponding to the first page print data to be printed by corresponding K, C, M and Y electrification rollers 112K, 112C, 112M and 112Y and corresponding K, C, M and Y scanning units 111K, 111C, 111M and 111Y (Step S2).

On the other hand, voltages, for example, 900V, which are applied to each deposit roller 114 of the K, C, M and Y developing devices 113K, 113C, 113M and 113Y are higher than those, for example 600V, which are applied to the developing rollers 107. Accordingly, differences in electric potential ΔV, for example, 300V, that is, deposit vectors V are respectively produced between the deposit rollers 114 and the developing rollers 107, so that K, C, M and Y liquid developer 148K, 148C, 148M and 148Y having a density in the range, for example, 3 through 15% solid reserved in the storage parts 106 are respectively deposited on the developing rollers 107 to form corresponding K, C, M and Y layers of developer having a density of, for example, 12 through 20% solid and an amount of developer of, for example, 200 μg/cm^2, thereon (Step S3).

Also, the metering rollers 115 of the K, C, M and Y developing devices 113K, 113C, 113M and 113Y respectively come in contact with the developing rollers 107 in a predetermined pressure, so that the corresponding K, C, M and Y layers of developer deposited thereon are regulated to a predetermined thickness. At this time, to prevent the K, C, M and Y layers of developer deposited on the developing roller 107 from moving onto the metering rollers 115 and contaminating them, predetermined voltages higher than those, that is, 600V, applied to the developing rollers 107 are applied to the metering rollers 115.

Figure 9:
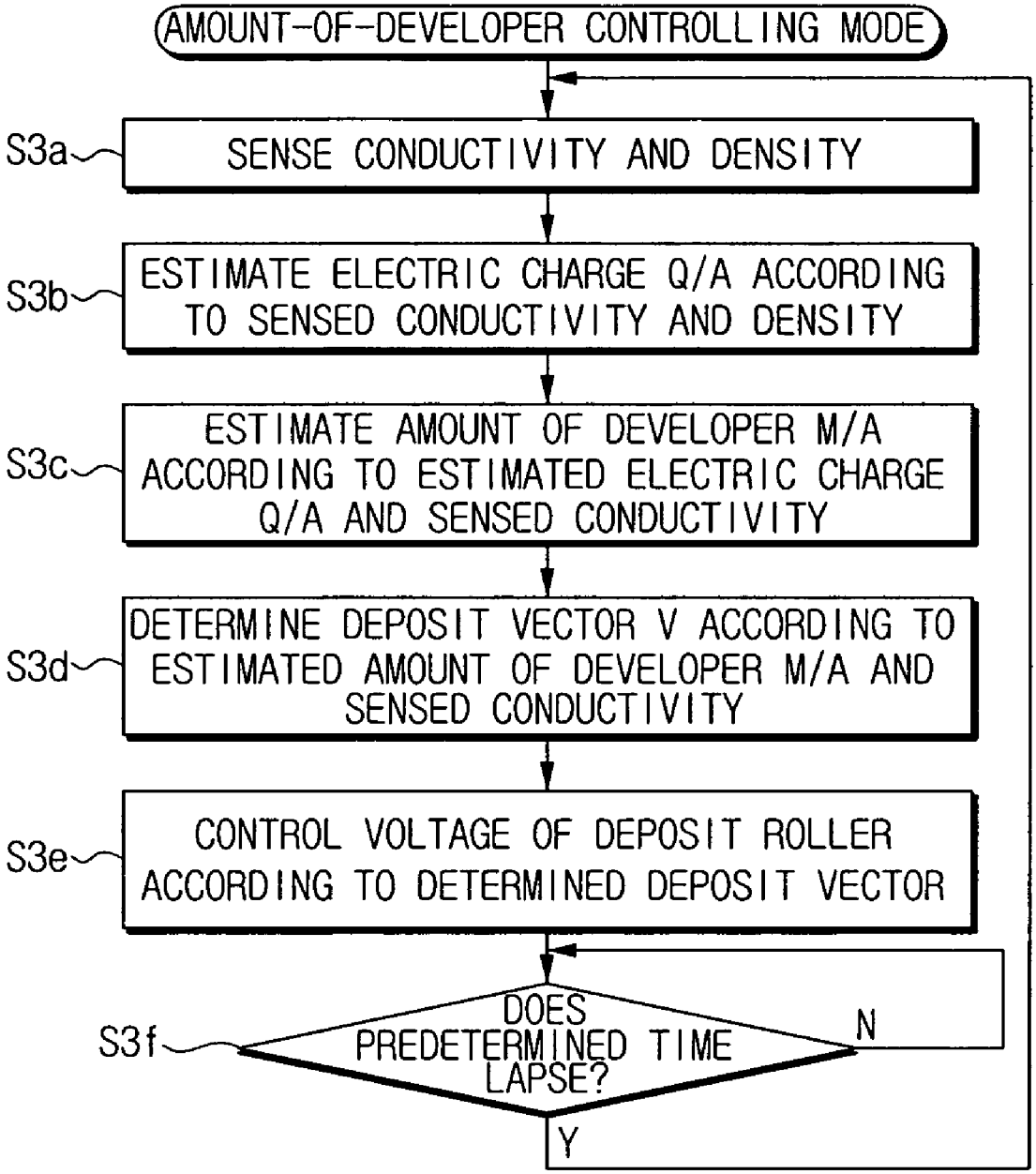
FIG. 9 is a flowchart exemplifying a developer controlling mode, which is carried out at a layer-of-developer forming step of the process of the image forming method of FIG. 8.

While the K, C, M and Y layers of developer are respectively formed on the developing rollers 107 of the K, C, M and Y developing devices 113K, 113C, 113M and 113Y at the step S3, the developer controlling unit 170 is carried out in a developer controlling mode for uniformly controlling amounts of developer M/A deposited on the developing rollers 107 to about 200 μg/cm^2, as shown in FIG. 9. During the developer controlling mode, the developer controlling unit 170 updates voltages to be applied to the deposit rollers 114 in a cycle of predetermined time by deposit vectors V which are determined according to conductivities and densities of corresponding K, C, M and Y liquid developers 148K, 148C, 148M and 148Y, and/or electric charges Q/M and amounts of developer M/A estimated by the conductivities and the densities. Then, the developer controlling unit 170 applies the updated voltages to the deposit rollers 114.

More specifically, as shown in FIG. 9, the first and second sensors 171 and 172 of the K, C, M and Y sensing parts 173K, 173C, 173M, and 173Y sense conductivities and densities from corresponding K, C, M and Y liquid developers 148K, 148C, 148M and 148Y having a density in the range of, for example, 3 through 15% solid reserved in corresponding storage parts 106 of the K, C, M and Y image forming units 105K, 105C, 105M, and 105Y, and output sensing signals to the control part 174 (Step S3*a*).

According to the sensing signals from the first and second sensors 171 and 172 of the K, C, M and Y sensing parts 173K, 173C, 173M, and 173Y, the control part 174 reads values of electric charge Q/M corresponding to the sensed conductivities and densities from the memory part 177, and thereby estimates present electric charges Q/M of the K, C, M and Y liquid developer 148K, 148C, 148M and 148Y (Step S3*b*).

Subsequently, the control part 174 reads values of amount of developer M/A corresponding to the conductivities sensed by the first sensors 171 and the estimated present electric charges Q/M of the K, C, M and Y liquid developer 148K, 148C, 148M and 148Y from the memory part 177, and thereby estimates present amounts of developer N/A deposited on the developing rollers 107 of the K, C, M and Y image forming units 105K, 105C, 105M and 105Y (Step S3*c*).

Then, the controlling part 174 reads values of deposit vector V corresponding to the estimated present amounts of developer N/A and the sensed conductivities sensed by the first sensors 171 from the memory part 177, and thereby determines differences in electric potential ΔV between the developing rollers 107 and the deposit rollers 114, that is, deposit vectors V, which can control the amounts of developer M/A deposited on the developing rollers 107 of the K, C, M and Y image forming units 105K, 105C, 105M and 105Y to about 200 μg/cm^2 (Step S3*d*).

Then, the control part 174 determines applied voltages for the deposit rollers 114 of the K, C, M and Y image forming units 105K, 105C, 105M and 105Y according to the determined deposit vectors V, and applies the determined voltages thereto (Step S3*e*).

After that, the control part 174 determines whether a predetermined time has lapsed (Step S3*f*), and if lapsed, repeats the operation step S3*a*.

After the layers of developer, having a uniform amount of developer M/A of about 200 μg/cm^2 and a uniform thickness, are formed on the developing rollers 107 at step S3 as described above, they move to nips between the developing rollers 107 and the corresponding photoconductors 109K, 109C, 109M and 109Y. At this time, predetermined differences in electric potential are formed between the developing rollers 107 and the electrostatic latent images with the low electric potential formed on the corresponding photoconductors 109K, 109C, 109M and 109Y. Portions of the layers of developer on the developing rollers 107, which are located opposite to the electrostatic latent images, are attached to the electrostatic latent image of the corresponding photoconductors 109K, 109C, 109M and 109Y due to electric fields produced by the predetermined differences in electric potential, whereby the K, C, M and Y developer images 149 having a density in the range of, for example, 20 through 25% solid, are formed on the corresponding photoconductors 109K, 109C, 109M and 109Y (step S4).

After the electrostatic latent images of the K, C, M and Y of the photoconductor 109K, 109C, 109M and 109Y are developed by the corresponding K, C, M and Y layers of developer of the developing rollers 107, the respective cleaning rollers 116 clean developers remaining on the corresponding developing rollers 107.

The K, C, M and Y developer images 149 formed on the K, C, M and Y photoconductors 109K. 109C, 109M and 109Y are overlappingly transferred onto the image transfer belt 117 by voltage and pressure exerted by the corresponding first image transfer rollers 108 located inside of the image transfer belt 117, thereby forming a developer image having a density in the range of, for example, 25 through 30% solid (Step S5).

As the image transfer belt 117 is rotated along the first, second and third support rollers 119, 120, 121 by the belt driving roller 122, the developer image is moved to the second image transfer roller 123, and transferred to the image receiving medium P by voltage and pressure exerted by the second image transfer roller 123 (Step S6).

The image transferred to the image receiving medium P is fixed on the image receiving medium P by the heating roller 125 and the compressing roller 126, thus forming the final desired image (Step S7).

Thereafter, the image receiving medium P is discharged out of the printer 100 by the paper-discharge roller 132 and the paper-discharge backup roller 134 of the paper discharge unit 130.

After the developer image formed on the image transfer belt 117 has been transferred to the image receiving medium P, the image transfer belt 117 is continuously rotated and arrives at the cleaning roller 154. The cleaning roller 154 is mounted to contact with the image forming surface of the image transfer belt 117 proximate a side of the third support roller 121. Developer refuse remaining on the surface of the image transfer belt 117 (typically 90-98% of developer is transferred to a sheet of record paper rather than 100%) is primarily cleaned by the cleaning roller 154, removed from the image transfer belt 117 by the cleaning blade 151, and then recovered to the waste developer storage part 152 (Step S8).

Then, it is determined whether there is a next page print data (Step S9). As a result at the step S9, if there is no next page print data, the print operation is finished. If there is a next page print data, the image transfer belt 117 performs again the above-mentioned operations after the step S2 through the respective photoconductors 109K, 109C, 109M and 109Y, the respective laser scanning units 111K, 111C, 111M and 111Y and the respective developing devices 113K, 113C, 113M and 113Y.

As apparent from the forgoing description, in the developer controlling apparatus for the developing roller, the image forming apparatus having the same and the developer controlling method thereof, the control part determines the deposit vectors V determining the voltages applied to the developing rollers and/or the deposit rollers during the developing, in consideration of the conductivities and the densities of the liquid developers. Therefore, the amounts of developer M/A deposited on the developing rollers can be correctly and precisely controlled compared with those at the conventional printer that which determines the deposit vectors V with the conductivities or the densities, thereby more uniformly controlling the layers of developer formed on the developing rollers.

Also, the control part can determine the deposit vectors V for determining the voltages applied to the developing rollers and/or the deposit rollers during the developing, in consideration of the conductivities and the densities of the liquid developers, and the electric charges Q/M and the amounts of developer M/A estimated by the densities of the liquid developers. Therefore, the amounts of developer M/A deposited on the developing rollers can be correctly and precisely controlled compared with those at the conventional printer that determines the deposit vectors V with the conductivities or the densities, thereby more uniformly controlling the layers of developer formed on the developing rollers.

While the invention has been shown and described with reference to certain embodiments thereof, it will be understood by those skilled in the art that various changes in form and details may be made therein without departing from the spirit and scope of the exemplary embodiments of the invention as defined by the appended claims.

What is claimed is:

1. A developer apparatus for a developing roller, comprising:

a sensing part having a first sensor which senses a conductivity of liquid developer and a second sensor which senses a density of the liquid developer;

a deposit roller for depositing the liquid developer to the developing roller to form a layer of developer; and a control part, which controls a voltage applied to at least one of the developing roller and the deposit roller according to the conductivity and the density sensed by the sensing part.

2. The apparatus as claimed in claim 1, wherein the first sensor comprises a conductivity sensor which electrically senses the conductivity of the liquid developer.

3. The apparatus as claimed in claim 1, wherein the second sensor comprises a density sensor which optically senses the density of the liquid developer.

4. The apparatus as claimed in claim 1, further comprising a memory part which stores data predetermined according to conductivities and densities to determine the voltage applied to the at least one of the developing roller and the deposit roller;

wherein the control part selects a value corresponding to the conductivity and the density sensed by the sensing part from the data, and thereby controls the voltage applied to the at least one of the developing roller and the deposit roller.

5. The apparatus as claimed in claim 4, wherein the data comprises a predetermined plurality of values of electric charge Q/M according to the conductivities and the densities, a predetermined plurality of values of an amount of developer M/A according to the plurality of values of the electric charge Q/M and the conductivities, and a predetermined plurality of values of deposit vector V according to the plurality of values of the amount of developer M/A and the conductivities for controlling the amount of developer M/A on the developing roller to a target amount of the developer M/A.

6. The apparatus as claimed in claim 5, wherein the values of deposit vector V are values of difference in electric potential between the deposit roller and the developing roller;

wherein the control part estimates a present electric charge Q/M from a value of electric charge Q/M corresponding to the conductivity and the density sensed by the sensing part ,stored in the memory part, estimates a present amount of developer M!A from a value of amount of developer M/A corresponding to the estimated present electric charge Q/M and the sensed conductivity stored in the memory part, determines a deposit vector V from a value of deposit vector V corresponding to the estimated present amount of developer M/A and the sensed conductivity stored in the memory part, and then controls the voltage applied to the at least one of the developing roller and the deposit roller according to the determined deposit vector V.

7. The apparatus as claimed in claim 4, wherein the data comprises a plurality of values of deposit vector V predetermined according to the conductivities and the densities for controlling an amount of developer M/A on the developing roller to a target amount of developer M/A.

8. The apparatus as claimed in claim 7, wherein the values of deposit vector V are values of difference in electric potential between the deposit roller and the developing roller;

wherein the control part determines a deposit vector V from a value of deposit vector V corresponding to the conductivity and the density sensed by the sensing part stored in the memory part, and then controls the voltage applied to the at least one of the developing roller and the deposit roller according to the determined deposit vector V.

9. An image forming device comprising:

an image forming unit having a developing roller for attaching a liquid developer to an electrostatic latent image to develop the electrostatic latent image into a visible image, and a deposit roller for depositing the liquid developer to the developing roller to form a layer of developer; and a developer controlling unit, which controls an amount of developer M/A deposited on the developing roller by the deposit roller;

wherein the developer controlling unit comprises:

a sensing part comprising a first sensor, which senses a conductivity of a liquid developer, and a second sensor, which senses a density of the liquid developer; and a control part, which controls a voltage applied to at least one of the developing roller and the deposit roller according to the conductivity and the density sensed by the sensing part.

10. The image forming device as claimed in claim 9, wherein the first sensor comprises a conductivity sensor which electrically senses the conductivity of the liquid developer.

11. The image forming device as claimed in claim 9, wherein the second sensor comprises a density sensor which optically senses the density of the liquid developer.

12. The image forming device as claimed in claim 9, wherein the developer controlling unit further comprises a memory part for storing data predetermined according to conductivities and densities to determine the voltage applied to the at least one of the developing roller and the deposit roller;

wherein the control part selects a value corresponding to the conductivity and the density sensed by the sensing part from the data, and thereby controls the voltage applied to the at least one of the developing roller and the deposit roller.

13. The image forming device as claimed in claim 12, wherein the data comprises a predetermined plurality of values of electric charge Q/M according to the conductivities and the densities, a predetermined plurality of values of amount of developer M/A according to the plurality of values of electric charge Q/M and the conductivities, and a predetermined plurality of values of deposit vector V according to the plurality of values of the amount of developer M/A and the conductivities for controlling the amount of developer M/A on the developing roller to a target amount of developer M/A.

14. The image forming device as claimed in claim 13, wherein the values of deposit vector V are values of difference in electric potential between the deposit roller and the developing roller;

wherein the control part estimates a present electric charge Q/M from a value of electric charge Q/M corresponding to the conductivity and the density sensed by the sensing part ,stored in the memory part, estimates a present amount of developer M/A from a value of amount of developer M/A corresponding to the estimated present electric charge Q/M and the sensed conductivity stored in the memory part, determines a deposit vector V from a value of deposit vector V corresponding to the estimated present amount of developer M/A and the sensed conductivity stored in the memory part, and then controls the voltage applied to the at least one of the developing roller and the deposit roller according to the determined deposit vector V.

15. The image forming device as claimed in claim 12, wherein the data comprises a plurality of values of deposit vector V predetermined according to the conductivities and the densities for controlling an amount of developer M/A on the developing roller to a target amount of developer M/A.

16. The image forming device as claimed in claim 15, wherein the values of deposit vector V are values of difference in electric potential between the deposit roller and the developing roller;

wherein the control part determines a deposit vector V from a value of deposit vector V corresponding to the conductivity and the density sensed by the sensing part stored in the memory part, and then controls the voltage applied to the at least one of the developing roller and the deposit roller according to the determined deposit vector V.

17. A developer controlling method of an image forming device comprising the steps of:

sensing a conductivity and a density of a liquid developer;

controlling a voltage applied to at least one of a developing roller and a deposit roller according to the sensed conductivity and density; and employing the deposit roller to deposit the liquid developer to the developing roller to form a layer of developer.

18. The developer controlling method as claimed in claim 17, wherein the step of sensing the conductivity and the density comprises:

electrically sensing the conductivity of the liquid developer; and optically sensing the density of the liquid developer.

19. The developer controlling method as claimed in claim 17, wherein the step of controlling the voltage comprises:

determining a voltage applied to the at least one of the developing roller and the deposit roller according to the sensed conductivity and density; and controlling a voltage applied to the at least one of the developing roller and the deposit roller according to the determined voltage.

20. The developer controlling method as claimed in claim 19, wherein the step of determining the voltage comprises:

estimating a present electric charge Q/M according to the sensed conductivity and density;

estimating a present amount of developer M/A according to the estimated present electric charge Q/M and the sensed conductivity; and determining a deposit vector V which controls an amount of developer M/A on the developing roller to a target amount of developer M/A according to the estimated amount of developer M/A and the sensed conductivity.

21. The developer controlling method as claimed in claim 20, wherein the deposit vector V is a difference in electric potential between the deposit roller and the developing roller;

wherein the step of controlling the applied voltage comprises controlling a voltage applied to the at least one of the developing roller and the deposit roller according to the determined deposit vector V.

22. The developer controlling method as claimed in claim 19, wherein the step of determining the voltage comprises estimating a deposit vector V according to the sensed conductivity and density.

23. The developer controlling method as claimed in claim 22, wherein the deposit vector V is a difference in electric potential between the deposit roller and the developing roller;

wherein the step of controlling the applied voltage comprises controlling a voltage applied to the at least one of the developing roller and the deposit roller according to the determined deposit vector V.

* * * * *